US006722305B2

(12) United States Patent
Mizushima

(10) Patent No.: US 6,722,305 B2
(45) Date of Patent: Apr. 20, 2004

(54) ELECTRICAL EQUIPMENT ARRANGEMENT FOR SMALL WATERCRAFT

(75) Inventor: Yoshihiro Mizushima, Shizuoka (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/100,614

(22) Filed: Mar. 15, 2002

(65) Prior Publication Data

US 2003/0024454 A1 Feb. 6, 2003

(30) Foreign Application Priority Data

Jul. 31, 2001 (JP) ..... 2001-232324

(51) Int. Cl.[7] ..... B63B 17/00
(52) U.S. Cl. ..... 114/343; 114/55.5
(58) Field of Search ..... 114/55.5, 343, 114/363; 123/635; 206/320, 811

(56) References Cited

U.S. PATENT DOCUMENTS 4,321,433 A * 3/1982 King ..... 455/344
4,465,189 A * 8/1984 Molzan ..... 206/524.8
4,489,770 A * 12/1984 Reich, II ..... 206/320
4,528,925 A * 7/1985 Pyburn ..... 114/61.23
4,919,637 A * 4/1990 Fleischmann ..... 114/333
5,097,789 A * 3/1992 Oka ..... 114/363
5,342,230 A * 8/1994 Louis ..... 441/42
5,524,597 A 6/1996 Hiki et al. ..... 123/635
5,894,810 A * 4/1999 Orr ..... 114/343
5,980,065 A * 11/1999 Wooderson ..... 362/267
6,111,519 A * 8/2000 Bloss et al. ..... 340/870.02
6,309,267 B1 10/2001 Okabe et al. ..... 440/77

* cited by examiner

*Primary Examiner*—S. Joseph Morano
*Assistant Examiner*—Lars A. Olson
(74) *Attorney, Agent, or Firm*—Knobbe, Martens, Olson & Bear LLP.

(57) ABSTRACT

A personal watercraft includes a hull and an engine. The hull defines an engine compartment and the engine is disposed within the engine compartment. A waterproof electrical component container is disposed in the engine compartment. The container can include two internal compartments, one being more water-tight than the other. The container can also include an aperture defined in one of the external surfaces of the container, through which an electrical component inside the container can be accessed when the aperture is open.

13 Claims, 11 Drawing Sheets

ELECTRICAL EQUIPMENT ARRANGEMENT FOR SMALL WATERCRAFT

PRIORITY INFORMATION

This application is based on Japanese Application No. 2001-232324, filed Jul. 31, 2001, the entire contents of which is hereby expressly incorporated by reference.

BACKGROUND OF THE INVENTION

1. Field of the Invention

The present invention relates generally to electrical equipment arrangement for a small watercraft, and more particularly to an improved electrical equipment arrangement for a small watercraft that includes a container with plural compartments containing electrical components.

2. Description of Related Art

Relatively small watercrafts such as, for example, personal watercrafts have become very popular in recent years. This type of watercraft is quite sporting in nature and carries one or more riders. An internal combustion engine powers a jet propulsion unit that propels the watercraft by discharging water rearwardly. A hull of the watercraft forms an engine compartment and a tunnel in the rear-most and underside of the watercraft. The engine lies within the engine compartment. The jet propulsion unit generally is placed within the tunnel and includes an impeller driven by the engine to discharge the water.

The watercraft typically includes electrical equipment such as, for example, an electrical control unit (ECU) for controlling the engine operation, which could also be used for an automobile engine. However, a watercraft operates in an environment rich with moisture, and thus, such electrical equipment is likely to be exposed to water splash or waterdrops. The electrical equipment, therefore, preferably is positioned within a water-resistant container. Certain engines that are designed for more accurate combustion control can include a number of electrical components such as, for example, sensors, relays and couplers. Thus, a large container is inevitably required to contain all the components. On the other hand, however, the engine compartment of a watercraft is limited in volume. Thus, it can be difficult to place a large container in such an engine compartment, due to the compact nature of the hull.

SUMMARY OF THE INVENTION

A need therefore exists for an improved electrical equipment arrangement for a small watercraft that can allow all the electrical equipment to be disposed within an engine compartment of the watercraft even though a relatively compact container is employed.

In accordance with one aspect of the present invention, a watercraft includes a hull, an internal combustion engine disposed in the hull, and a first plurality of electrical components for the engine. The first plurality includes an electronic control unit and at least one additional electronic component. A second plurality of electrical components for the engine includes electrical components that are not waterproof. The watercraft also includes a container having at least first and second interior compartments, the first and second interior compartments including a watertight seal. The seal of the second compartment is more waterproof than the seal of the first compartment. The first plurality of electrical components are disposed in the first compartment and the second plurality of electrical components are disposed in the second compartment.

In accordance with another aspect of the present invention, a watercraft includes a hull defining an engine compartment. An internal combustion engine is disposed within the engine compartment. The watercraft also includes a container mounted in the engine compartment. The container includes a body, a removable cover, an aperture defined in one of the body and cover and opening into an interior of the container. A cap is configured to form a water-tight seal with the aperture. At least one electrical component is accessible through the aperture when the cap is removed form the aperture.

BRIEF DESCRIPTION OF THE DRAWINGS

These and other features, aspects and advantages of the present invention will now be described with reference to the drawings of a preferred embodiment which is intended to illustrate and is not to limit the invention. The drawings comprise 16 figures.

DETAILED DESCRIPTION OF THE PREFERRED EMBODIMENT OF THE INVENTION

Figure 1:
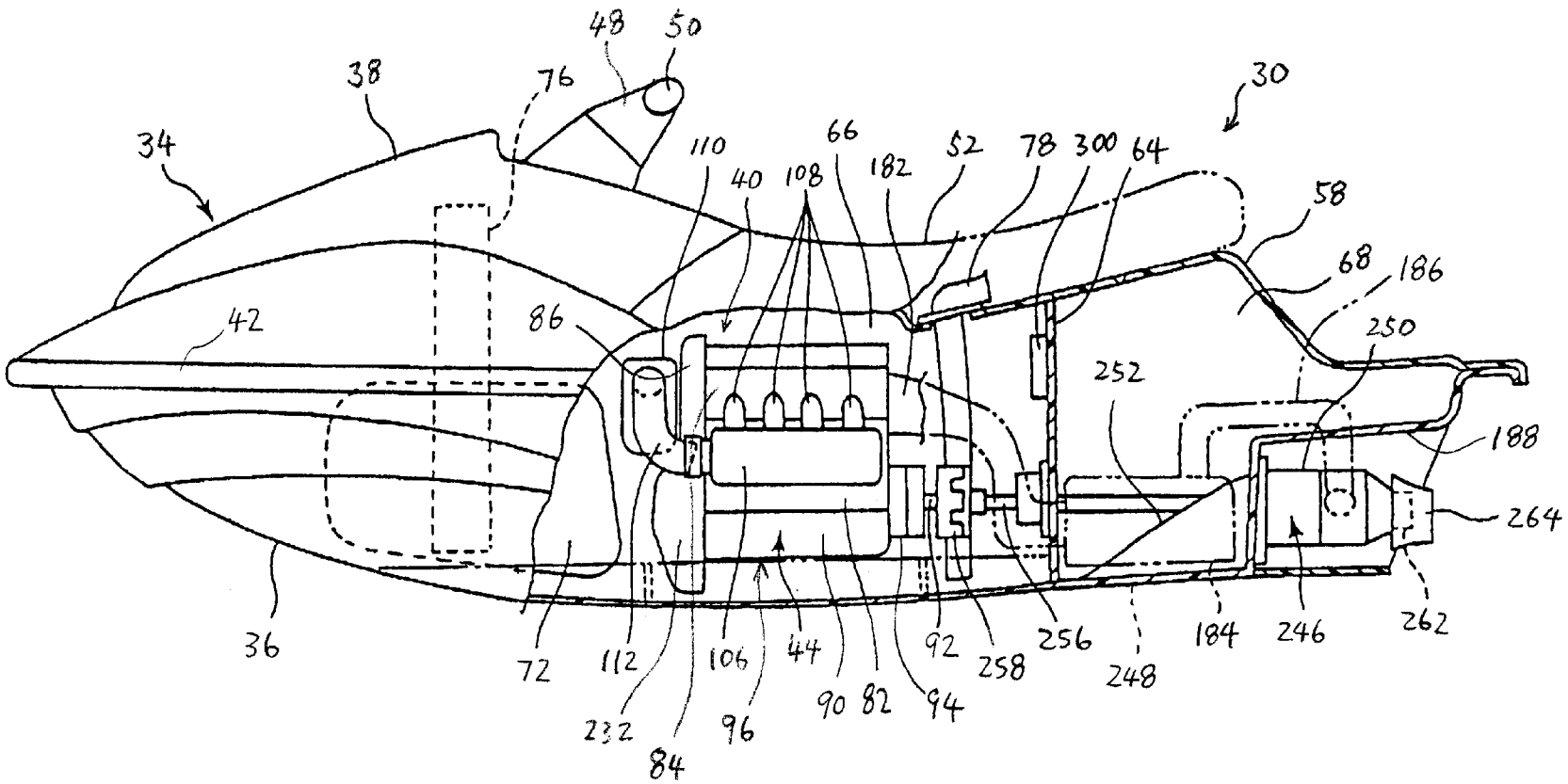
FIG. 1 is a side elevational view of a personal watercraft configured in accordance with a preferred embodiment of the present invention. The watercraft is partially sectioned to show an engine (illustrated schematically) and a jet propulsion unit thereof.

With reference to FIGS. 1–11, an overall construction of a personal watercraft 30 configured in accordance with the present invention is described below.

The personal watercraft 30 includes a hull 34 generally formed with a lower hull section 36 and an upper hull section or deck 38. Both the hull sections 36, 38 are made of, for example, a molded fiberglass reinforced resin or a sheet molding compound. The lower hull section 36 and the upper hull section 38 are coupled together to define an internal space 40 therebetween. An intersection of the hull sections 36, 38 is defined in part along an outer surface gunwale or bulwark 42. The hull 34 houses an internal combustion engine 44 that powers the watercraft 30.

In the illustrated embodiment, a bow portion of the upper hull section 38 slopes upwardly. A steering mast 48 extends generally upwardly toward the top of the bow portion to support a handle bar 50. The handle bar 50 is provided primarily to allow the rider to change a thrust direction of the watercraft 30. The handle bar 50 also carries control devices such as, for example, a throttle lever (not shown) for controlling the engine 44.

A seat 52 extends behind the steering mast 48 fore to aft along a longitudinal axis of the watercraft 30. The seat 52 is configured generally with a saddle shape so that the rider can straddle the seat 52.

The upper hull section 38 includes a seat pedestal 58 that forms a pair of side walls which support at least a portion of the seat 52. The side walls extend fore to aft along the longitudinal axis of the watercraft 30 and become wider toward the bottom. The seat 52 comprises a cushion and a rigid backing and is detachably supported by the seat pedestal 58 with the backing disposed atop the pedestal 58.

An access opening (not shown) is defined on the top surface of the pedestal 58 and under the seat 52. The rider can conveniently access the internal space 40 through the access opening. Footwells are defined on either side of the side walls and on an upper surface of the upper hull section 38. The seat 52 and the footwells together define a riders' area.

One or more bulkheads can divide the internal space 40 into multiple compartments. In the illustrated embodiment, one bulkhead 64 separates the insternal space into a forward compartment 66 and a rear compartment 68. The bulkhead 64 extends generally vertically to define a vertical wall.

The forward compartment 66 defines an engine compartment. The engine 44 is placed within the engine compartment 66 generally under the seat 52, although other locations are also possible (e.g., beneath the steering mast 48 or in the bow). The location, however, can provide the rider with an easy access to the engine 44 through the opening by detaching the seat cushion 60 from the seat pedestal 58.

A fuel tank 72 is placed in the engine compartment 40 under the bow portion of the upper hull section 38 and in front of the engine 44. The fuel tank 72 is coupled with a fuel inlet port (not shown) positioned atop the upper hull section 38 through a proper duct.

A pair of air ventilation ducts 76 extend on either side of the upper hull section 38 in the bow portion area. Another air ventilation duct 78 also extends through the seat pedestal 58 in the rear area of the engine 44. The ambient air can enter and exit the engine compartment 40 through the ventilation ducts 76, 78. Except for the ventilation ducts 76, 78, the internal space 40 is generally sealed to prevent water from entering.

The engine 44 in the illustrated arrangement operates on a four-cycle combustion principle. The engine 44 defines four cylinders spaced apart from each other along the longitudinal axis of the watercraft 30. The engine 44 thus is a L4 (in-line four cylinder) type. The illustrated four-cycle engine, however, merely exemplifies one type of engine. Engines having other number of cylinders including a single cylinder, having other cylinder arrangements (e.g., V and W type) and other cylinder orientations (e.g., upright cylinder banks) and operating on other combustion principles (e.g., two-cycle, diesel, or rotary).

The engine 44 typically comprises a cylinder block 82 defining four cylinder bores, each defining a respective cylinder. Pistons (not shown) reciprocate within the cylinder bores.

Figure 3:
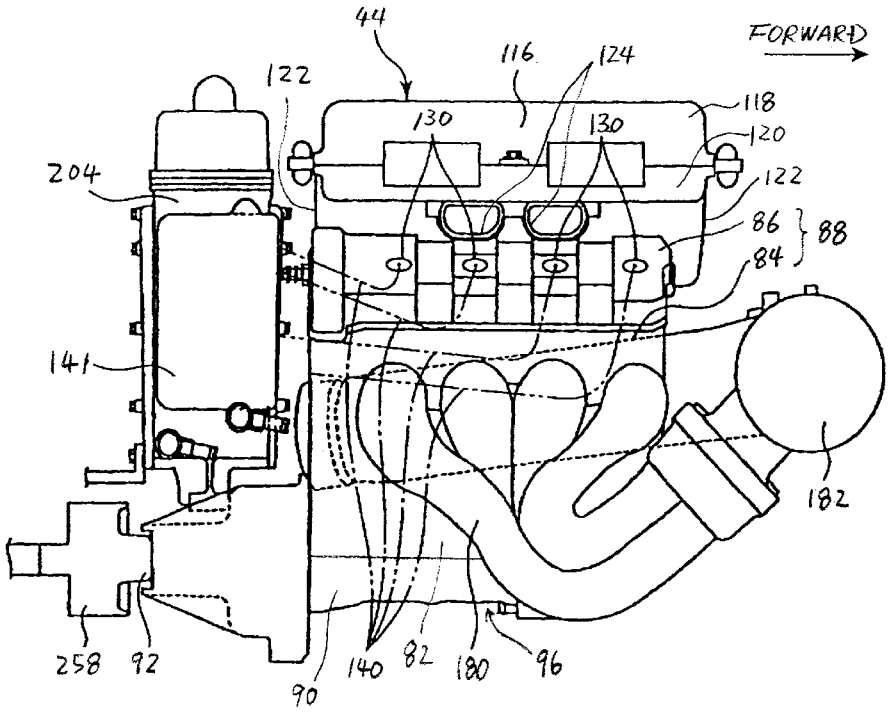
FIG. 3 is a side elevational view of the engine shown in FIG. 2, except for a plenum chamber mounted above the engine.

A cylinder head member 84 is affixed to the upper end of the cylinder block 82 to close respective upper ends of the cylinder bores and defines combustion chambers 85 (FIG. 4) with the cylinder bores and the pistons. A cylinder head cover member 86 is affixed to a top portion of the cylinder head member 84 to define a cylinder head assembly 88 (FIG. 3).

A crankcase member 90 is also affixed to the lower end of the cylinder block to close the respective lower ends of the cylinder bores and to define a crankcase chamber with the cylinder block 82. A crankshaft 91 (FIGS. 8 and 11) is journaled for rotation within the crankcase chamber and is connected with the pistons so that the crankshaft 91 rotates with the pistons reciprocating. The crankshaft 91 extends along the longitudinal axis of the watercraft 30 and is connected to an output shaft 92 (FIG. 1) disposed behind the engine 44 and being offset from the crankshaft 91 through a gear connection 94 including a reduction gear. The output shaft 92 thus can rotate in a fixed reduction ratio relative to the crankshaft 91. The cylinder block 82, the cylinder head member 84, the cylinder head cover member 86 and the crankcase member 90 preferably are made of aluminum alloy and together define an engine body 96.

Engine mounts (not shown) extend from either side of the engine body 96. The engine mounts preferably include resilient portions made of flexible material, for example, a rubber material. The engine body 96 is mounted on the lower hull section 36, specifically, a hull liner, by the engine mounts so that vibrations from the engine 44 are attenuated.

Figure 4:
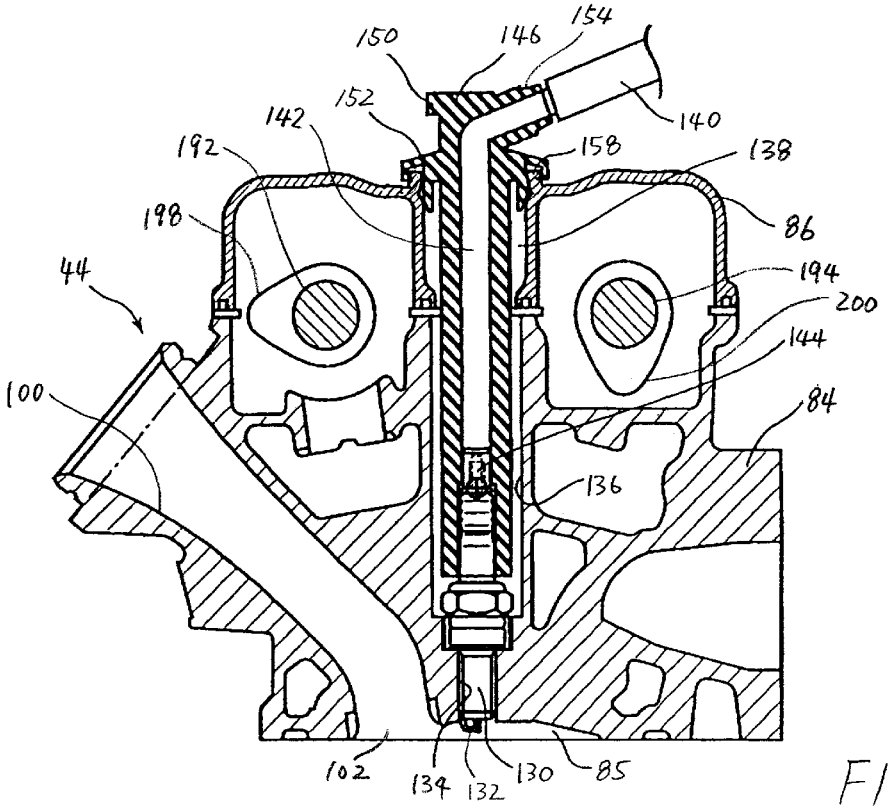
FIG. 4 is a partial, sectional and enlarged view of a cylinder head of the engine shown in FIG. 2, including a spark plug cap.
Figure 5:
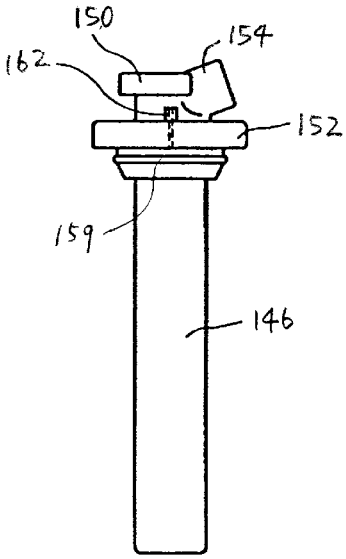
FIG. 5 is a side elevational view of the spark plug cap showin in FIG. 4.

With particular reference to FIGS. 1 and 4, the engine 44 preferably comprises an air induction system to guide air to the combustion chambers 85. The illustrated air induction system includes four inner intake passages 100 (FIG. 4) defined in the cylinder head member 84 on the port side. The intake passages 100 communicate with the associated combustion chambers 85 through one or more intake ports 102. Intake valves (not shown) are provided at the intake ports 102 to selectively connect and disconnect the intake passages 100 with the combustion chambers 85. In other words, the intake valves move between open and closed positions of the intake ports 102.

The illustrated induction system also includes a plenum chamber unit 106 (FIG. 1) disposed next to the cylinder block 82 on the port side. Four runners 108 are disposed between the cylinder block 82 and the cylinder head member 84 to define four outer intake passages therein that connect a plenum chamber member defined within the plenum chamber unit 106 and the inner intake passages 100. The plenum chamber smoothes intake air and quiets intake air. A second intake silencer 110 is disposed in front of the engine body 96 in this arrangement to further quiet the intake air. A coupling conduit 112 couples the second intake silencer 110 with the plenum chamber unit 106. An air inlet (not shown) is defined at the second intake silencer 110 to draw air in the engine compartment 66 to the induction system.

Other arrangements of the induction system of course are applicable. For instance, FIG. 3 illustrates an another exemplary arrangement of the induction system. A modified plenum chamber unit 116 is disposed above the engine body 96. Upper and lower chamber members 118, 120, which generally have a rectangular shape, are coupled together to define a plenum chamber therein and the lower chamber member 120 is affixed to the cylinder head cover member 86 by a plurality of stays 122. A pair of inlet members extend from the lower chamber member 120 to define inlet openings 124 through which air in the engine compartment 66 is drawn into the induction system. Four throttle bodies (not shown) connect the plenum chamber with the inner intake passages 100.

A throttle valve is journaled for pivotal movement on either each runner 108 or each throttle body with a valve shaft. Preferably, the valve shaft links all of the throttle valves. The pivotal movement of the valve shaft is controlled by the throttle lever on the handle bar 50 through a control cable. The rider thus can control an opening degree of the throttle valves by operating the throttle lever to obtain various engine speeds. That is, an amount of air passing through the runners 108 or throttle bodies is measured or regulated by this mechanism. Normally, the greater the opening degree, the higher the rate of airflow and the higher the engine speed.

Figure 7:
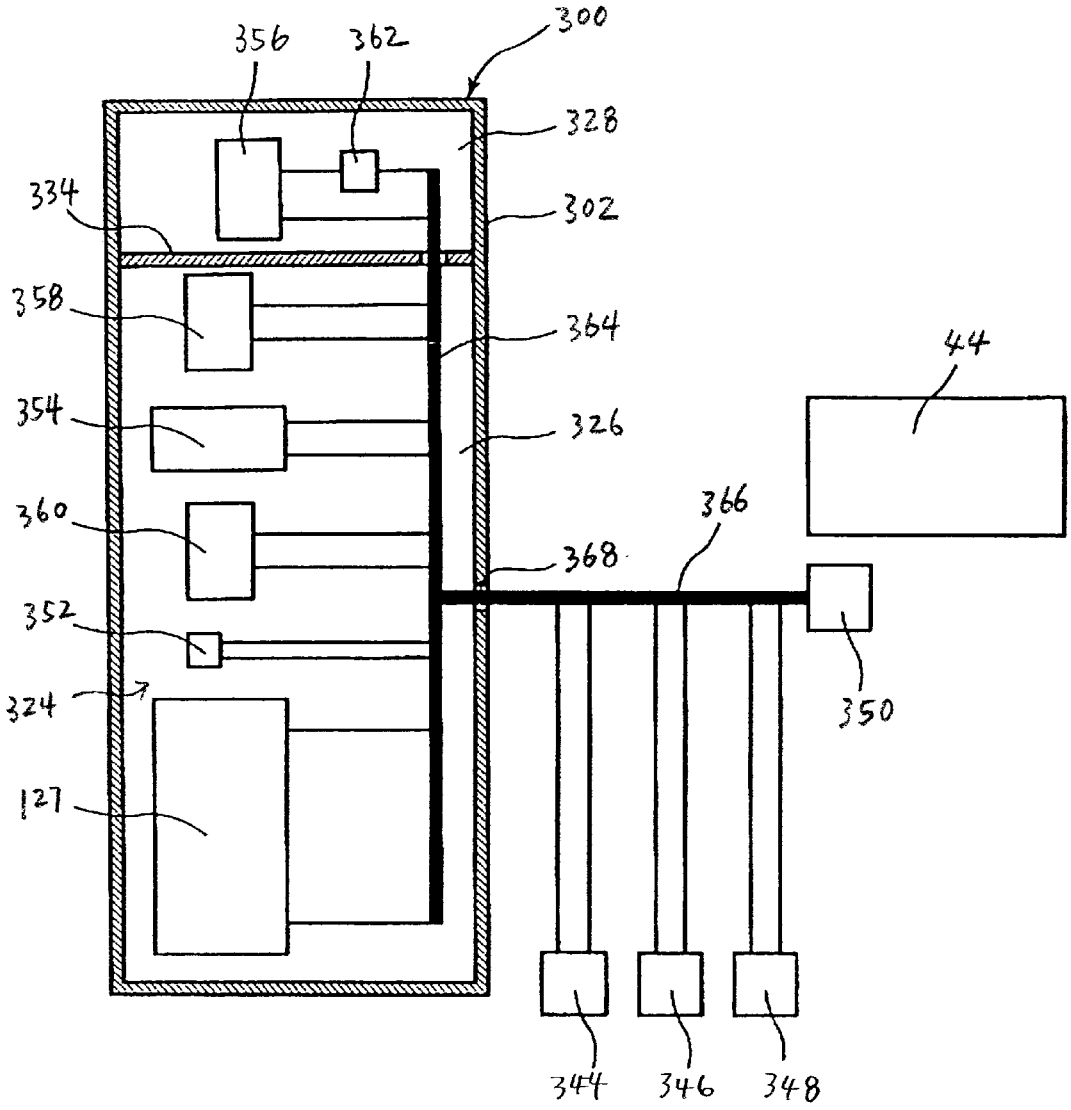
FIG. 7 is a schematic view of an electrical equipment arrangement for the watercraft. A container for some components of the electrical equipment is illustrated in section.

The engine 44 preferably comprises an indirect or port injected fuel supply system. The fuel supply system includes four fuel injectors (not shown) with one injector allotted to each runner 108 or each throttle body. The fuel injectors have injection nozzles opening downstream of the throttle valves. The fuel injectors spray fuel through the nozzles at certain injection timing and for certain duration under control of an electronic control unit (ECU) 126 (FIG. 7).

The sprayed fuel is drawn into the combustion chambers 85 together with the air to form an air/fuel charge therein. The fuel tank 72 stores fuel for the fuel injectors. At least one fuel pump is provided to supply the fuel in the fuel tank 72 to the injectors. A direct fuel injection system that sprays fuel directly into the combustion chambers 85 can replace the indirect fuel injection system described above. Moreover, other charge forming devices such as, for example, carburetors can be used instead of the fuel injection system.

With particular reference to FIGS. 2–6, the engine 44 preferably comprises a firing or ignition system. The ignition system includes four spark plugs 130, one spark plug allotted to each combustion chamber 85. The spark plugs 130 are affixed to the cylinder head member 84 so that electrodes 132, which are defined at bottom ends of the plugs 130, are exposed to the respective combustion chambers 85 through threaded holes 134. Opposite ends of the spark plugs 130 extend upwardly through plug holes 136 defined in the cylinder head member 84. The plug holes 136 communicate with a location out of the cylinder head member 84 through apertures 138 defined in the cylinder head cover member 86.

The spark plugs 130 preferably are connected to a power source such as, for example, one or more batteries (not shown) through high-voltage lines 140 via an ignition device such as, for example, ignition coils (not shown). An ignition coil box 141 (FIGS. 2 and 3), described below in greater detail, preferably contains the ignition coils.

An end portion 142 of each high-voltage line 140 has a connector 144 and is covered with a rubber-made plug cap 146 together with the connector 144. Preferably, the plug cap 146 is molded with the end portion of the high-tension cord 140 and the connector 144 inserted. The plug caps 146 are fitted into the apertures 138 and the plug holes 136 toward the top ends of the spark plugs 130. Because the plug caps 146 have center axes that are consistent with axes of the spark plugs 130, the connectors 144 can be easily coupled with the spark plugs 130.

Each plug cap 146 in this arrangement has an upper flange 150 and a lower flange 152. The upper flange 150 has an outer diameter smaller than an outer diameter of the lower flange 152 and generally forms a projection 154 through which the end portion 142 of the high-tension cord 140 extends.

Figure 6:
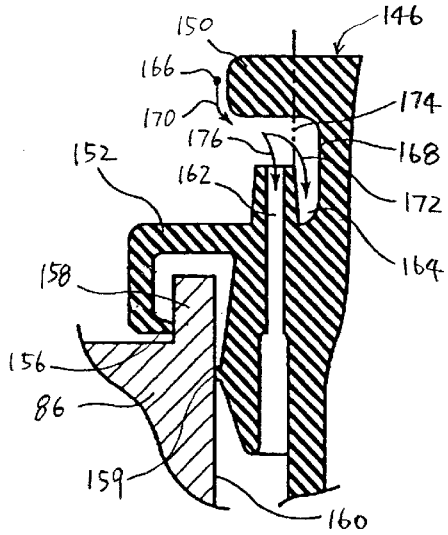
FIG. 6 is an enlarged sectional view of the spark plug cap. A top portion of the cylinder head assembly also is partially shown in section.

With particular reference to FIG. 6, the lower flange 152 forms a circular lip 156 at which the plug cap 146 is engaged, in a substantially water-tight manner, with a circular projection 158 of the cylinder head cover member 86 extending upwardly. Another circular lip 159 protrudes around a side surface of the plug cap 146 below the circular lip 156. The circular lip 159 also adheres closely to an inner surface 160 of the aperture 138 to inhibit water or moisture from entering the plug hole 136. In other words, water or moisture is double blocked from entering the plug hole 136 by the circular lips 156, 159.

Each plug cap 146 preferably forms one or more through-holes 162 so that air can enter and exit a space between the plug cap 146 and the aperture 138, such that the space remains at atmospheric pressure. Preferably, a circular groove 164 is defined next to a top portion of the through-holes 162 and is positioned closer to the center axis of the plug cap 146.

Occasionally, when the engine 44 is not running, waterdrops 166 adhere onto the upper flange 150 and fall down to the circular groove 164 along a side surface 168 of the plug cap 146 as indicated by the arrows 170, 172. The waterdrops quickly evaporate when the engine 44 warms during use. If, however, the grooves 164 were not provided and the side surface 168 extended along the phantom line 174, the waterdrops could enter the through-holes 162 and would reach the plug hole 136 as indicated by the arrow 176. The groove 164 thus is quite useful in inhibiting waterdrops from entering the plug hole 136.

The spark plugs 130 fire the air/fuel charges in the combustion chambers 85 at an ignition timing under control of the ECU 127. The air/fuel charge thus is burned within the combustion chambers 85 to move the pistons opposite to the combustion chambers 85.

The engine 44 preferably comprises an exhaust system configured to guide burnt charges, i.e., exhaust gases, from the combustion chambers 85. In the illustrated embodiment, the exhaust system includes four inner exhaust passages (not shown) defined within the cylinder head member 84. The exhaust passages communicate with the associated combustion chambers 85 through one or more exhaust ports (not shown). Exhaust valves (not shown) are provided at the exhaust ports to selectively connect and disconnect the exhaust passages from the combustion chambers 85. In other words, the exhaust valves move between open and closed positions of the exhaust ports.

Figure 2:
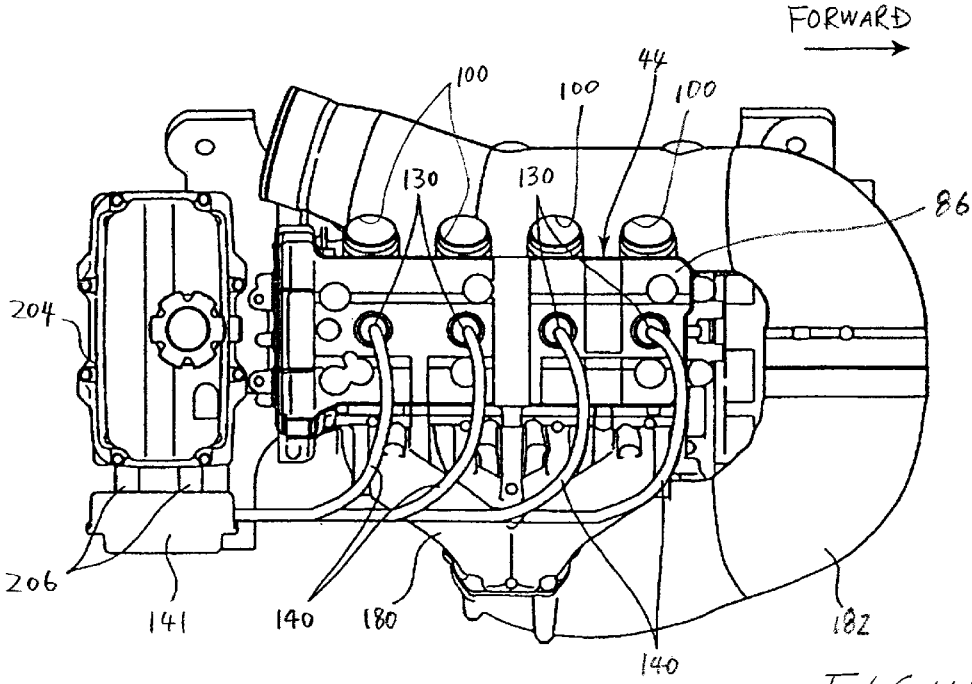
FIG. 2 is a top plan view of the engine of FIG. 1.

With particular reference to FIGS. 1–3, an exhaust manifold 180 depends from the cylinder head member 84 at a starboard side surface thereof. The exhaust manifold 180 is connected with the inner exhaust passages to collect exhaust gases from the respective inner exhaust passages.

An exhaust conduit 182 is connected with the exhaust manifold 180 downstream thereof and extends forwardly on the starboard side, turns toward the port side and then further extends rearwardly on the port side. An end portion of the exhaust conduit 182 in the illustrated arrangement passes through the bulkhead 64 to the rear compartment 68. The end portion of the exhaust conduit 182 is connected to a water-lock or exhaust silencer 184 disposed in the rear compartment 68.

A discharge pipe 186 extends generally rearwardly from the water-lock 184 and is connected to a portion of a tunnel 188. The tunnel 188 is a recessed portion formed on the underside of the lower hull section 36. The discharge pipe 186 opens to the exterior of the watercraft 30 in a submerged position. Thus, the exhaust gases are discharged to a body of water surrounding the watercraft 30 through the discharge pipe 186.

With particular reference to FIG. 4, the engine 44 includes a valvetrain drive for actuating the intake and exhaust valves. In the illustrated embodiment, the valvetrain drive comprises a double overhead camshaft drive including an intake camshaft 192 and an exhaust camshaft 194. The intake and exhaust camshafts 192. 194 actuate the intake and exhaust valves, respectively. The intake camshaft 192 extends generally horizontally over the intake valves, substantially parallel to the longitudinal axis of the watercraft 30, while the exhaust camshaft 194 extends generally horizontally over the exhaust valves 146 generally parallel to the intake camshaft 192. Both the intake and exhaust camshafts 192, 194 are journaled for rotation by the cylinder head member 84.

The intake and exhaust camshafts 192, 194 each have cam lobes 198, 200. Each cam lobe 198, 200 is associated with each one of the intake valves and the exhaust valves, respectively. The intake and exhaust valves are biased to a closed position via, for example, springs. When the intake and exhaust camshafts 192, 194 rotate, the respective cam lobes push the associated valves to open the respective ports against the biasing force of the springs. The air thus can enter the combustion chambers when the intake valves are opened and the exhaust gases can move out from the combustion chambers when the exhaust valves are open.

The crankshaft 91 preferably drives the intake and exhaust camshafts 192, 194. Preferably, the respective camshafts 192, 194 have driven sprockets affixed to ends thereof. The crankshaft 91 also has a drive sprocket. A flexible transmitter such as, for example, a timing chain or belt (not shown) is wound around the drive and driven sprockets. When the crankshaft 91 rotates, the drive sprocket drives the driven sprockets via the flexible transmitter, and then the intake and exhaust camshafts 192, 194 rotate also.

The ambient air enters the engine compartment 66 through the ventilation ducts 76, 78. The air is drawn to the induction system and flows into the combustion chambers 85 when the intake valves are opened. The air amount is regulated by the throttle valves. At the same time, the fuel injectors spray fuel into the intake ports under the control of the ECU 127. Air/fuel charges are thus formed and are delivered to the combustion chambers 85. The air/fuel charges are fired by the spark plugs 130 also under the control of the ECU 127. The burnt charges, i.e., exhaust gases, are discharged to the body of water surrounding the watercraft 30 through the exhaust system. The combustion of the air/fuel charges causes the pistons reciprocate within the cylinder bores and thereby causes the crankshaft 91 to rotate.

With particular reference to FIGS. 2, 3, 8–10, the engine 44 preferably comprises a lubrication system that delivers a lubricant, such as oil, to engine portions for inhibiting frictional wear of such portions. In the illustrated embodiment, a closed-loop type, dry-sump lubrication system is employed. Lubricant oil for the lubrication system preferably is stored in a lubricant tank 204 (FIGS. 2 and 3) disposed at the rear of the engine body 96. The foregoing ignition coil box 141 preferably is affixed to the lubricant tank 204. In the illustrated arrangement, a pair of brackets 206 extend from a side surface of the lubricant tank 204 on the starboard side and the ignition coil box 141 is affixed to the brackets 206. Because the illustrated ignition coil box 141 is disposed relatively close to the spark plugs 130, the high-voltage lines 140 can be shortened. Also, because the ignition coil box 141 is mounted on the lubricant tank 204 via the brackets 206, a space is formed between the coil box 141 and the tank 204 to reduce heat transfer therebetween.

An oil filter unit 208 (FIGS. 8 and 9) is detachably mounted on the crankcase member 90 on the port side. The oil filter unit 208 contains at least one filter element to remove foreign substances from the lubricant oil circulating in the lubrication system. The oil filter unit 208 also can separate water from the lubricant oil. The lubrication system includes a feed pump and a scavenge pump both of which are preferably driven by the crankshaft 91 in the circulation loop to deliver the lubricant oil from the lubricant tank 204 to the engine portions that need lubrication and then return it to the tank 204.

Figure 8:
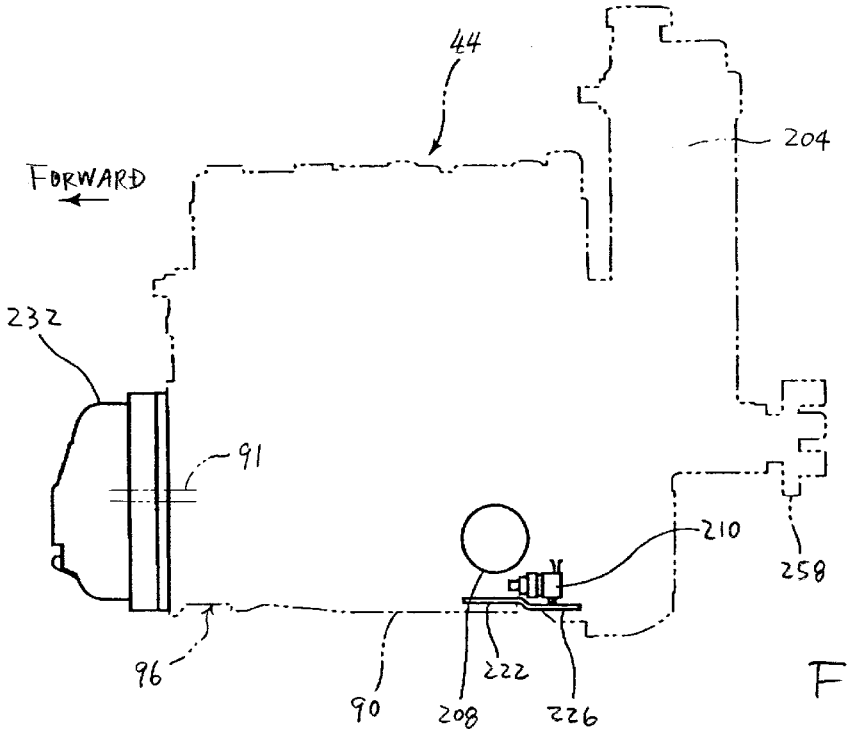
FIG. 8 is a side elevational view of the engine of FIG. 2, showing an oil filter unit, an oil pressure sensor and a generator cover. The engine, except for these components, is illustrated in phantom line.

In the illustrated arrangement, an oil pressure sensor 210 is provided in the proximity of the oil filter unit 208. More specifically, the oil pressure sensor 210 is positioned close to the bottom of the engine body 96 as best shown in FIG. 8. The oil pressure sensor 210 has a sensor tip 211 (FIG. 10) that is exposed to a lubricant passage 212 defined inside of the crankcase member 90. The oil pressure sensor 210 is connected to the ECU 127 by wire-harness or several wires 214.

Figure 10:
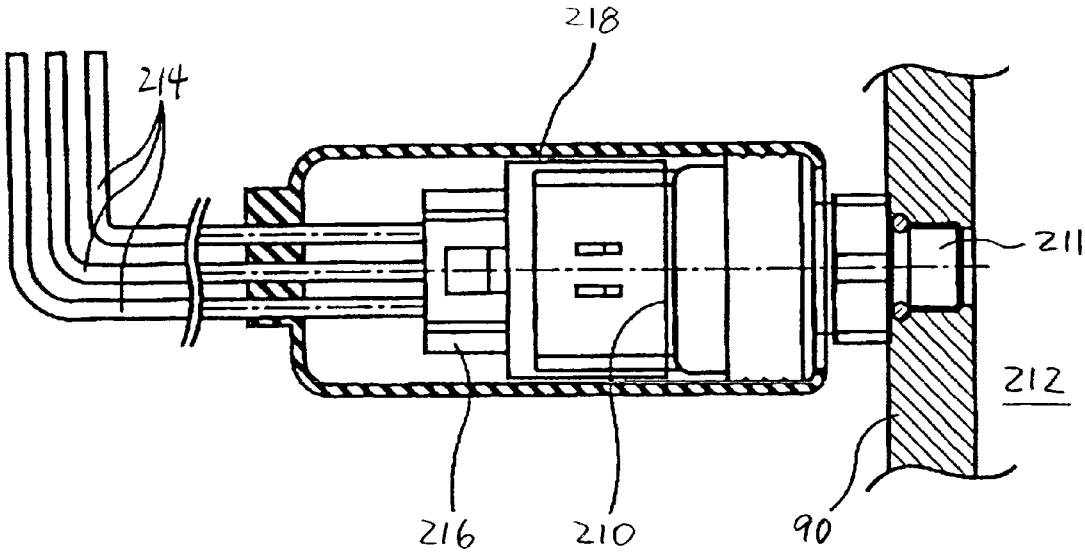
FIG. 10 is an enlarged side elevational view of the oil pressure sensor. The oil pressure sensor in this figure is covered with a rubber boot (shown in section).

Due to the location, the illustrated oil pressure sensor 210 is likely to be surrounded by water accumulated at the bottom of the engine compartment 66. Thus, the illustrated oil pressure sensor 210 is coupled with the wires 214 by a water-resistant coupler 216. Furthermore, the oil pressure sensor 210 and the coupler 216 preferably are entirely covered with a rubber boot 218 as shown in FIG. 10. The boot 218 is not necessarily provided if the oil pressure sensor 210 is positioned higher with in the engine compartment 66.

Figure 9:
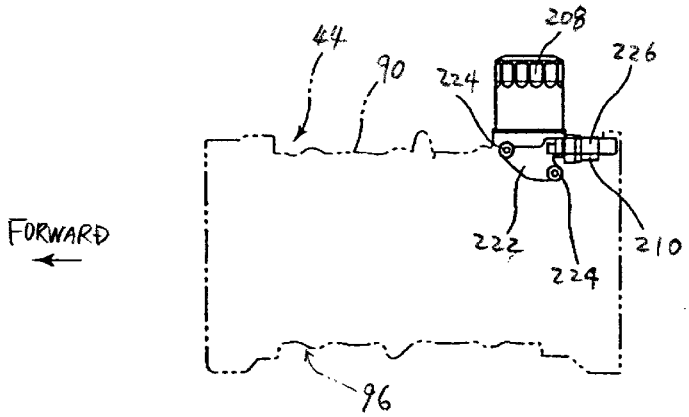
FIG. 9 is a top plan view of the engine of FIG. 8. The generator cover is omitted. The engine, except for the oil filter unit and the oil pressure sensor, is illustrated in phantom line.

It has been discovered that such an oil pressure sensor 210 can be damaged by bumping against the engine mounts when the engine body 96 is installed. Thus, a protection plate 222 preferably is affixed to the bottom of the crankcase member 90 by bolts 224 to substantially cover a bottom surface of the oil pressure sensor 210 with a cover section 226 thereof as shown in FIGS. 8 and 9. The protection plate 222 preferably is made of sheet metal.

Figure 11:
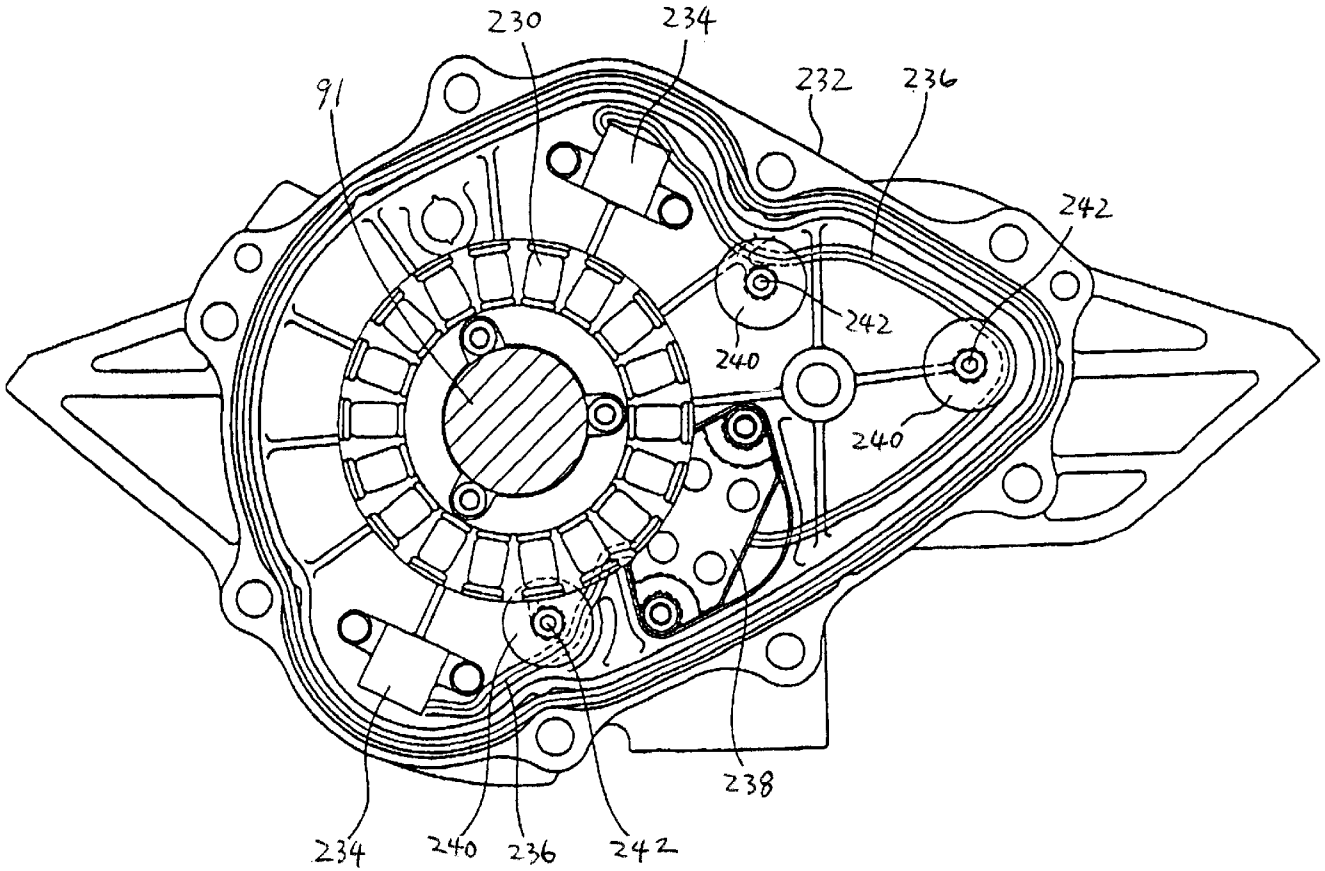
FIG. 11 is an rear elevational view of the generator cover of FIG. 9, removed from the engine.

With particular reference to FIGS. 8 and 11, the engine 44 preferably comprises an AC generator or flywheel magneto that generates electric power. The generator comprises a stator section including multiple stator coils 230 mounted on a generator cover 232 and a rotor section including one or more permanent magnets (not shown) mounted on the crankshaft 91. With the crankshaft 91 rotating, the rotor section moves relative to the stator section to generate electric power by the electromagnetic induction action. The electric power is supplied to the batteries to be used by electrical components such as, for example, the ECU 127.

Crankshaft position sensors or engine speed sensors 234 also are mounted on the generator cover 232 opposite to each other relative to the crank shaft 91. The crankshaft position sensors 234 are pulser coils and generate pulse signals whenever the magnets of the rotor section approach and depart. The signals are sent to the ECU 127 through wire-harness or several wires 236 via a rubber grommet 238 which is water-tightly fitted into an opening defined by the generator cover member 232. The illustrated wires 236 are advantageously interposed between the front surface of the crankcase member 90 and washers 240 which are affixed by bolts 242. That is, the wires 236 are neatly tied with each other by the washers 240 and will not hang down in a disorderly manner.

The engine 44 preferably comprises a starter motor (not shown) mounted on, for example, the engine body 96 to start the engine 44 with a starter switch. The starter motor has a starter gear meshed with a ring gear that is coupled with the crankshaft 91. When the rider turns on the starter switch, the starter motor rotates to move the crankshaft 91 through the gear connection. With the crankshaft 91 moving, the engine 44 starts. A one-way clutch associated with the starter motor to prevent the over-rotation of the starter motor.

The watercraft 30 preferably employs a water cooling system (not shown) for cooling the engine body 96 and the exhaust system. Preferably, the cooling system is an open-loop type that introduces cooling water from the body of water in which the watercraft is operating. The cooling system can include a water pump and a plurality of water jackets and/or conduits.

With reference to FIG. 1, a jet pump assembly or jet propulsion unit 246 propels the watercraft 30 in the illustrated embodiment. The jet pump assembly 246 is mounted in the tunnel 188. The tunnel 188 has a downward facing inlet port 248 opening toward the body of water. A pump housing 250 of the pump assembly 246 is disposed within a portion of the tunnel 164 and communicates with the inlet port 248 through a duct 252 formed at the lower hull section 36.

An impeller (not shown) is journaled for rotation within the pump housing 250. An impeller shaft 256 extends forwardly from the impeller through the bulkhead 64. The impeller shaft 256 is coupled with the output shaft 92 via a coupling unit 258. Because the output shaft 92 is connected to the crankshaft 91, the impeller shaft 256 rotates with the crankshaft 91 rotating.

A rear end of the pump housing 250 defines a discharge nozzle 262. A deflector or steering nozzle 264 is affixed to the discharge nozzle 262 for pivotal movement about a steering axis which extends approximately vertically. A cable (not shown) connects the deflector 264 with the steering mast 48 so that the rider can steer the deflector 264, and thereby change the direction of travel of the watercraft 30. Additionally, a reverse bucket (not shown) can pivotally mounted on the deflector 264 about an axis which extends generally horizontally. The reverse bucket is configured such that when it is in a lowered position (not shown), water discharged through the deflector 264 is directed forwardly, thereby generating reverse thrust. The rider thus can move the watercraft 30 backwardly by lowering the reverse bucket over the nozzles 262, 264.

When the crankshaft 91 of the engine 44 drives the impeller shaft 256 through the output shaft 92, the impeller rotates. Water is drawn from the surrounding body of water through the inlet port 248. The pressure generated in the pump housing 250 by the impeller produces jet stream of the water that is discharged through the discharge nozzle 262 and the deflector 264. The water jet produces thrust to propel the watercraft 30. The rider can steer the deflector 264 with the handle bar 50 of the steering mast 48 to turn the watercraft 30 in either right or left direction.

With continued reference to FIGS. 1 and 7 and with additional reference to FIGS. 12–16, a preferred electrical equipment arrangement will now be described below.

With particular reference to FIG. 1, a container 300 preferably is mounted on the bulkhead 64 which extends generally vertically and is disposed within the engine compartment 66. The container 300 contains some pieces of electrical equipment in accordance with an exemplary strategy described shortly. The illustrated container 300 is positioned almost atop the engine compartment 66 so that the rider can easily access the container 300 through the access opening only by detaching the seat 52. The position of the container 300 also is beneficial because the container 300 can be sufficiently apart from water which can accumulate at the bottom of the engine compartment 66.

Figure 12:
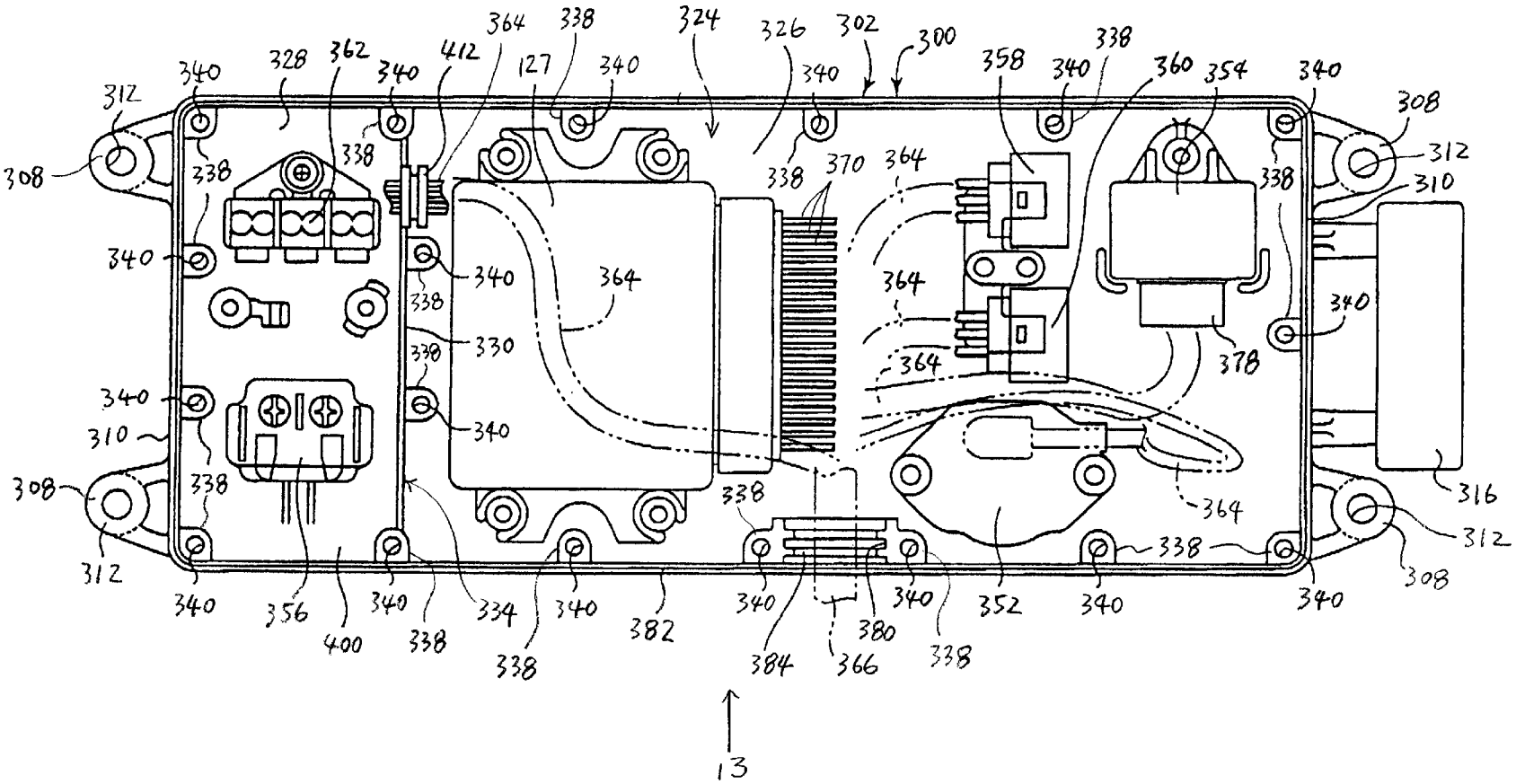
FIG. 12 is a front elevational view of the container shown in FIG. 7, with a cover member detached.
Figure 13:
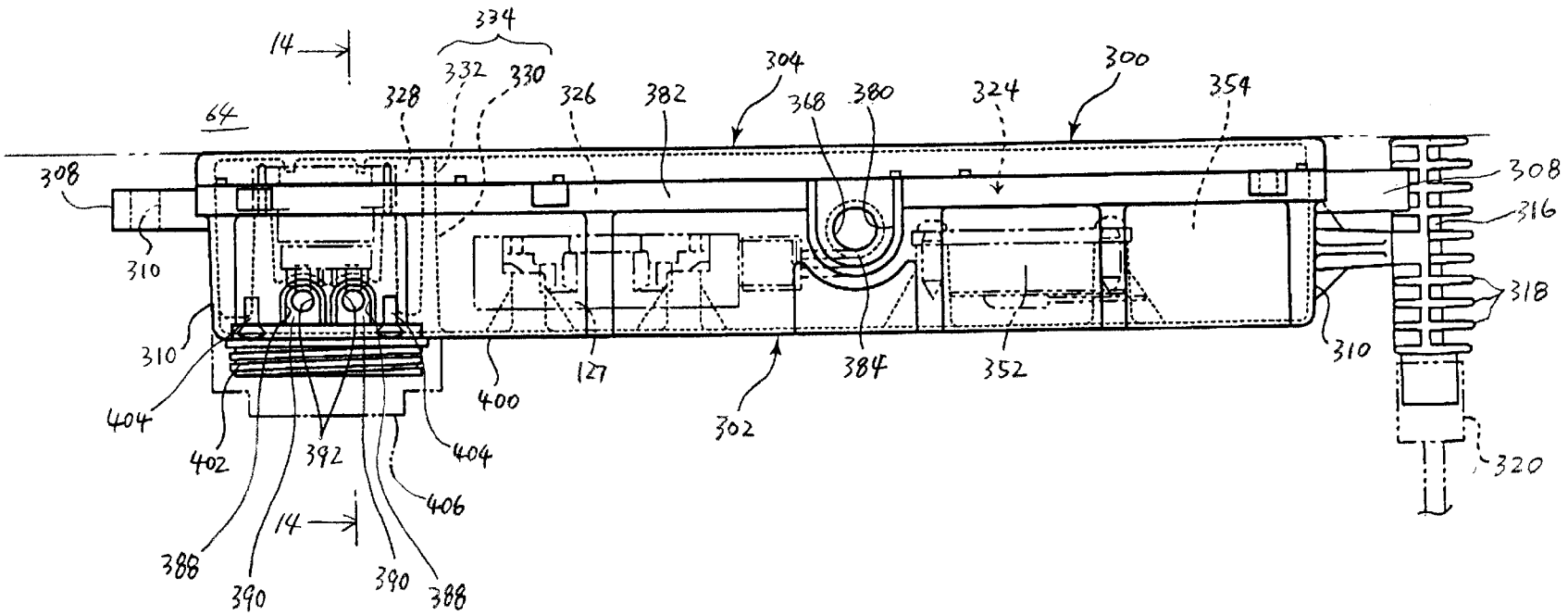
FIG. 13 is a top plan view of the container of FIG. 12 as viewed along the arrow 13 of FIG. 12, including a combined main relay and fuel pump relay unit.
Figure 14:
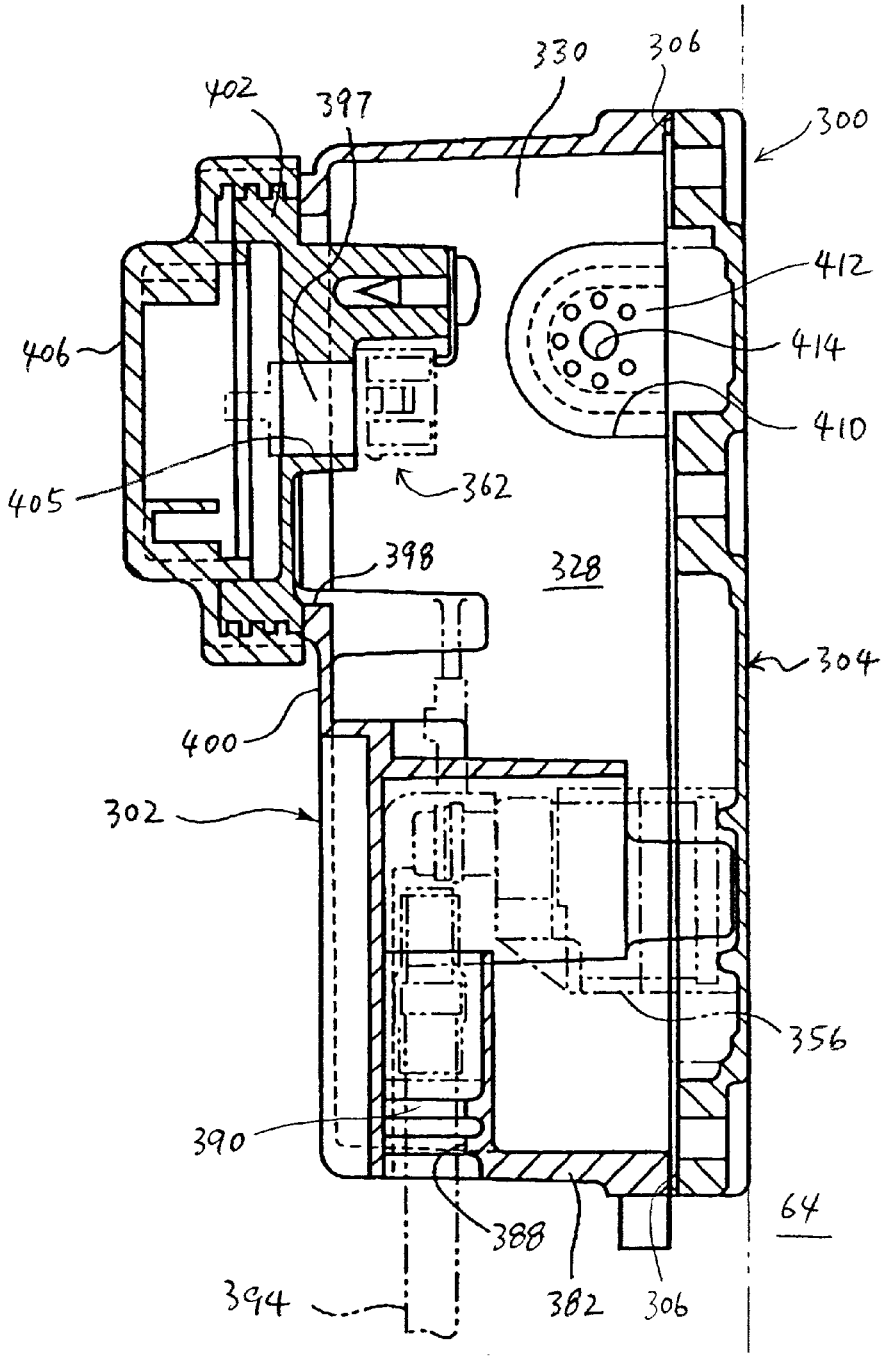
FIG. 14 is a sectional view of the container of FIG. 12 taken along the line 14—14 of FIG. 13.
Figure 15:
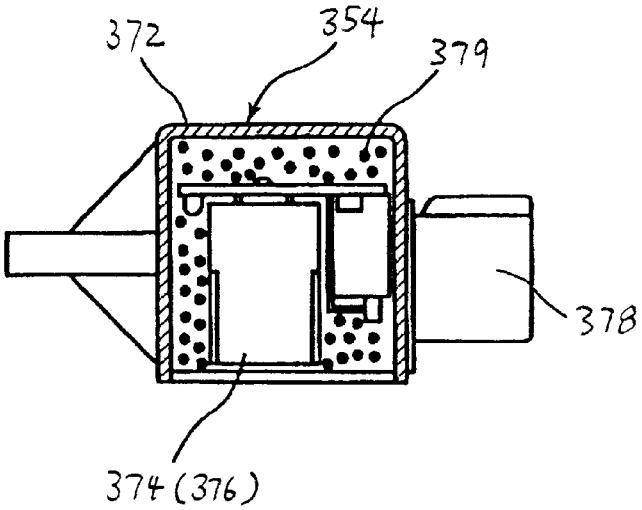
FIG. 15 is a side elevational and partial sectional view of the combined main relay and fuel pump relay unit. A casing of the relay unit is illustrated in section.
Figure 16:
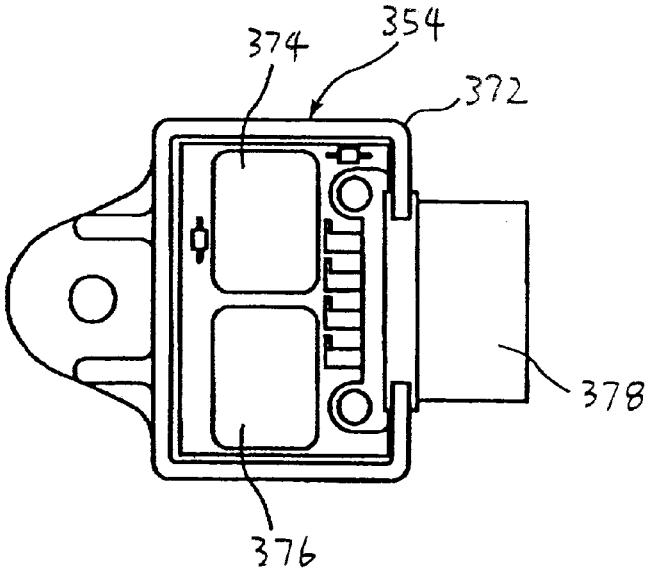
FIG. 16 is a front elevational view of the unit of FIG. 15 with afront cover removed.

With particular reference to FIGS. 12–14, the container 300 preferably comprises a container body or first container section 302 which has a generally rectangular shape. A cover member or second container section 304 also has a generally rectangular shape. Preferably, the container body 302 has a depth that is deeper than a depth of the cover member 304. Both the container body 302 and the cover member 304 preferably are made of plastic and are produced in, for example, a molding process. The cover member 304 is coupled with the container body 302 with a seal member 306 (FIG. 14) interposed therebetween.

The container body 302 preferably has a set of brackets 308 unitarily formed therewith on each side surface 310. One set includes two brackets 308. Each bracket 308 defines a bolt hole 312 and the container 300 is affixed to the bulkhead 64 at the brackets 308 by bolts with the cover member 304 interposed between the bulkhead 64 and the container body 302. As noted above, the container body 302 and cover 304 have a generally rectangular shape. Thus, the container 300 defines a major axis, a minor axis, and a thickness. The major axis extends along the longest dimension, i.e., the length of the container 300. The minor axis extends along the width of the container 300.

Preferably, the container 300 is arranged such that the major axis extends generally horizontally, with the thickness of the container 300 being measured along the longitudinal axis of the watercraft 30. As such, the container 300 can utilize the narrow volume of space adjacent the bulkhead. Additionally, by arranging the container 300 with its major axis extending generally horizontally, the electrical components concealed inside the container 300 remain at a height within the engine compartment 66 that is easily accessible through the access opening in the seat pedestal 58.

A rectifier-regulator assembly 316 is mounted on the side surface 310 on the starboard side by screws. The rectifier-regulator assembly 316 is connected between the AC generator and the batteries to rectify the AC current generated by the AC generator and to simultaneously regulate the output voltage. The rectifier-regulator assembly 316 has multiple fins to radiate heat generated by the rectification-regulation process. A connector 320 can be coupled with the rectifier-regulator assembly 316 to connect the assembly 316 to the AC generator and the batteries.

The container 300 defines a cavity 324 between the container body 302 and the cover member 304. The cavity 324 preferably is divided into a first compartment 326 and a second compartment 328. In the illustrated arrangement, the container body 302 has a partition 330 and the cover member 304 has a partition 332, as shown in FIG. 13. Both the partitions 330, 332 are formed at the same location in the container 300 to define a unified partition 334. Preferably, the first compartment 326 occupies four fifths of the cavity 324 on the starboard side, while the second compartment 328 occupies the remainder of the cavity 324 on the port side. The seal member 306 preferably has a portion corresponding to the partitions 330, 332 to be interposed therebetween as well as a peripheral portion corresponding to each peripheral portion of the container body 302 and the cover member 304.

The container body 302 has a plurality of inner joint portions 338 that define bolt holes 340. The density of the joint portions 338 around the periphery of the second compartment 328 is greater than a density of the joint portions 338 around the periphery of the first compartment 326, i.e., there are more joint portions 338 per inch along the periphery of the second compartment 328 than along the periphery of the first compartment 326.

The cover member 304 defines bolt holes (not shown) corresponding to the respective bolt holes 340. The cover member 304 is coupled with the container body 302 by bolts inserted into the respective bolt holes of the cover member 304 and the bolt holes 340 of the container body 302 with the seal member 306 interposed. Because of this arrangement of the joint portions 338, i.e., the density of the joint portions 338, the second compartment 328 can be more tightly sealed than the first compartment 326. In other words, electrical components disposed within the second compartment 328 can be better protected from water than electrical components disposed within the first compartment 326. Respective pressure-resistant references of the first and second compartments 326, 328 are different from each other. For example, the second compartment 328 preferably has a pressure-resistant reference of 0.3 atmosphere. The first compartment 326 preferably has a pressure-resistant reference of 0.05 atmosphere, although zero atmosphere also is available.

With reference to FIG. 7, electrical components for the engine 44 can be divided into two groups in the illustrated arrangement. A first group of the electrical equipment includes electrical components that do not operate properly or cause adverse problems in the power system if they leak electric current. For example, the first group of the electrical equipment includes electrical components that are directly or indirectly connected to a power source, i.e., the batteries in this arrangement. In other words, the electrical components of the first group are generally on the plus voltage side rather than on the grounded side. The components of this first group include, for example, the ECU 127, an over-turn sensor 352, a combined main relay and fuel pump relay unit 354, a starter relay unit 356, couplings 358, 360 and a fuse unit 362.

A second group of the electrical equipment, in turn, includes electrical components that can leak electric current without being permanently damaged or causing significant adverse problems in the power system, i.e., electrical components on the grounded side of the power system. For instance, the second group of the electrical equipment includes couplings 344, 346, 348 which are grounded. Small current sensors and/or switches 350 which are grounded also can be included in the second group of the electrical equipment. The foregoing oil pressure sensor 210 can be included in this second group of the electrical equipment.

In this arrangement, the electrical components 127, 352, 354, 356, 358, 360, 362 belonging to the first group are contained in the container 300, while the electrical components 344, 346, 348, 350 belonging to the second group are disposed at locations out of the container 300 and within the engine compartment 66. The first group components 127, 352, 354, 356, 358, 360, 362 are connected with each other by an inner wire-harness arrangement 364, the second group components 344, 346, 348, 350 are connected with each other by an outer wire-harness 366.

The outer wire-harness 366 enters the cavity 324 through an aperture 368 of the container 300 to be connected with the inner wire-harness 364. Typically, the current leak is apt to occur if electrical components are disposed in a wet environment. In the illustrated arrangement, however, the first group components are well protected by the container 300 which is sealed by the seal member 306 to prevent water from entering the cavity 324 as described above. The foregoing wire-harness or wires 214 for the oil pressure sensor 210 can be included in the outer wire-harness 366.

The second compartment 328 preferably contains electrical components which are generally less waterproof. In the illustrated arrangement, the starter relay unit 356 and the fuse unit 362 are commonly available in a non-waterproof. These less-expensive non-waterproof units can be used, if they are sufficiently protected from water. Thus, the starter relay unit 356 and the fuse unit 362 are disposed in the second compartment 328. The remainder of the components 127, 352, 354, 358, 360 can be contained in the first compartment 326 because each of those components, in this arrangement, have been manufactured with coverings that offer some water-protective properties.

With particular reference to FIGS. 12 and 13, the ECU 127 preferably is positioned within the first compartment 326 next to the partition 334 and is affixed to the container body 302. The ECU 127 has a plurality of connector pins 370 extending outwardly and connected with the inner wire-harness 364. The illustrated ECU 127 is relatively lightly waterproofed by, for example, a synthetic resin molding.

With particular reference to FIG. 12, the couplings 358, 360 are positioned next to the ECU 127 in the first compartment 326 and are aligned generally vertically. The couplings 358, 360 are affixed to the container body 302. Both the couplings 358, 360 and the couplings 344, 346, 348, which are located out of the container 300, define bases via which wire-harness or wires coming from various electrical components are conveniently connected or disconnected. All the couplings 344, 346, 348, 358, 360 used in this arrangement preferably are a water-resistant type. This type of coupling is manufactured with a covering so as to be well protected from water and corrosion.

With particular reference to FIGS. 12 and 13, under the couplings 358, 368 and next to the ECU 127, the turn-over sensor 352 is positioned and is affixed to the container body 302. The turn-over sensor 352 preferably contains a mercury ball that can move to a position at which a turn over signal is produced if the watercraft 30 turns over. The illustrated turn-over sensor 352 is at least lightly waterproofed. Otherwise, a more-expensive completely water-resistant construction can be used.

With particular reference to FIG. 12, the combined main relay and fuel pump relay unit 354 is positioned between the couplers 358, 360 and an inner side wall of the container 300 on the starboard side. The unit 354 also is affixed to the container body 302. With additional reference to FIGS. 15 and 16, the unit 354 comprises a casing 372, a main relay 374, a fuel pump relay 376 and a coupler 378. The relays 374, 376 are contained in the casing 372 and the coupler 378 is affixed to the casing 372. Printed circuits or wires (not shown) also are disposed within the casing 372 to connect the relays 374, 376 with each other and the coupler 378. Synthetic resin 379 preferably fills a space defined in the casing 372 to protect the relays 374, 376 and the printed circuits or wires particularly from water. The illustrated main relay 374 is used for sequential operation of electrical components of the watercraft 30. The fuel pump relay 376 is used for control of the fuel pump that supplies the fuel in the fuel tank 72 to the fuel injectors.

With particular reference to FIGS. 12 and 13, the illustrated container body 302 defines a recess 380 between two joint portions 338 located almost at a center portion of a bottom surface 382 of the container body 302. A rubber grommet 384 is fitted into the recess 380 to be interposed between the container body 302 and the cover member 304. The grommet 384 defines the foregoing aperture 368 through which the outer wire-harness 366 enters the first compartment 326 to be connected with the inner wire-harness 364. The grommet 384 provides a water-tight at the recess 380.

With particular reference to FIGS. 12–14, the starter relay unit 356 preferably is positioned within a lower space of the second compartment 328 and is affixed to the container body 302. The starter relay unit 356 supplies electric power to the starter motor from the batteries with the main switch turned on by the rider. The illustrated container body 302 defines a pair of openings 388 at the bottom surface 382 thereof adjacent to the starter relay unit 356. Rubber grommets 390 are fitted into the openings 388. Each grommet 390 defines an aperture 392 through which a wire or cable 394 goes out to the starter motor mounted on the engine body 96. The grommets 390 are configured to provide water-tight seals, like the grommet 384.

With continued reference to FIGS. 12–14, the fuse unit 362 preferably is positioned above the starter relay unit 356 in the second compartment 328 and detachably clasps one or more fuses 397 (FIG. 14). The illustrated container body 302 defines an opening 398 in the front surface 400 thereof. A fuse unit holder 402 is inserted into the opening 398 and is affixed to the front surface 400 of the container body 302 by screws 404. A seal member can be interposed between the fuse unit holder 402 and the container body 302.

The fuse unit holder 402 holds the fuse unit 356 thereon. At least an outer portion of the fuse holder 402 extending out of the opening 398 is cylindrically shaped and an outer side surface of this portion is threaded. Each thread has a rectangular shape in section as best shown in FIG. 14. A closure cap 406 is affixed to the outer portion of the fuse holder 402. The closure cap 406 also is cylindrically shaped and an inner side surface is threaded to completely fit in the shape of the outer surface of the fuse holder 402. The closure cap 406 thus can be water-tightly coupled with the fuse holder 402. With the closure cap 406 removed, the fuse 397 is accessible for exchange without detaching the cover member 304 from the container body 302.

The illustrated starter relay unit 356 and fuse unit 362 are mass produced and are generally appropriate for automotive applications including automobiles. These units, however, are not waterproofed sufficiently to simply be mounted in the engine compartment of a personal watercraft without further water-protection. However, the second compartment 328 can protect those components 356, 362 sufficiently from water because of the sealed construction of the container 300. Because such mass-produced components 356, 362 can be used within the second compartment 328, a total cost of the watercraft 30 can be reduced.

With particular reference to FIGS. 12 and 14, the illustrated partition 330 of the container body 302 defines a recess 410 on the rear surface. A rubber grommet 412 is fitted into the recess 410 to be interposed between the container body 302 and the cover member 304. The grommet 412 defines an aperture 414 through which the inner wire-harness 364 passes to extend both the first and second compartments 326, 328. The grommet 412 is configured to provide a water-tight seals at the recess 410.

Of course, the foregoing description is that of preferred constructions having certain features, aspects and advantages in accordance with the present invention Accordingly, various changes and modifications may be made to the above-described arrangements without departing from the spirit and scope of the invention, as defined by the appended claims.

What is claimed is:

1. A watercraft comprising a hull, an internal combustion engine disposed in the hull, a first plurality of electrical components for the engine, the first plurality comprising an electronic control unit and at least one additional electronic component, a second plurality of electrical components for the engine, the second plurality comprising electrical components that are not waterproof, a container having at least first and second interior compartments, the first and second interior compartments including a watertight seal, the seal of the second compartment being more waterproof than the seal of the first compartment, wherein the first plurality of electrical components are disposed in the first compartment and the second plurality of electrical components are disposed in the second compartment.

2. The watercraft as set forth in claim 1 additionally comprising a power source, the first and second pluralities of electrical components being connected to the power source.

3. The watercraft as set forth in claim 2 additionally comprising a third plurality of electrical components which are grounded, the third plurality of electrical components being disposed outside the container.

4. The watercraft as set forth in claim 1 additionally comprising a bulkhead disposed adjacent the engine, the container being mounted on the bulkhead.

5. The watercraft as set forth in claim 4, wherein the container is disposed between the engine body and the bulkhead.

6. The watercraft as set forth in claim 5, wherein the container is generally rectangular in shape, defining a major axis and a minor axis, the container being positioned such that the major axis extends generally horizontally.

7. The watercraft as set forth in claim 1 additionally comprising a seal member disposed between the first and second compartments, the seal member being configured to provide a substantially water-tight seal between the first and second compartments.

8. The watercraft as set forth in claim 1 additionally comprising an aperture opening into the second compartment, and a removable threaded cap configured to threadedly engage the aperture.

9. The watercraft as set forth in claim 8 additionally comprising a fuse disposed in the second compartment adjacent the aperture.

10. The watercraft as set forth in claim 9, wherein the aperture and the cap are configured to allow the fuse to be removed from the second compartment when the cap is removed from the aperture.

11. The watercraft as set forth in claim 10, wherein the container comprises a body and a removeable cover, the aperture being defined in one of the body and the cover.

12. The watercraft as set forth in claim 1 additionally comprising a plurality of fasteners connecting the cover with the body, a density of the fasteners being greater around a periphery of the second compartment than a density of the fasteners around a periphery of the first compartment.

13. An electrical component container comprising a body, a removable cover configured to form a substantially watertight seal with the body, the body and the cover defining at least first and second interior compartments therebetween, a seal between the body and the cover, the seal being configured such that the first interior compartment is more watertight than the second interior compartment, the first interior compartment housing an electronic control unit that is configured to control the operation of an internal combustion engine.

* * * * *